US011610449B2

(12) United States Patent
Trumpfheller et al.

(10) Patent No.: US 11,610,449 B2
(45) Date of Patent: Mar. 21, 2023

(54) DEVICE AND METHOD FOR CLASSIFYING VALUE DOCUMENTS, IN PARTICULAR BANK NOTES, AND VALUE DOCUMENT PROCESSING SYSTEM

(71) Applicant: GIESECKE+DEVRIENT CURRENCY TECHNOLOGY GMBH, Munich (DE)

(72) Inventors: Holger Trumpfheller, Munich (DE); Steffen Schmalz, Munich (DE); Norbert Holl, Germering (DE); Wolfgang Röhrl, Riemerling (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 874 days.

(21) Appl. No.: 16/349,029

(22) PCT Filed: Nov. 8, 2017

(86) PCT No.: PCT/EP2017/001302

§ 371 (c)(1),
(2) Date: May 10, 2019

(87) PCT Pub. No.: WO2018/086738

PCT Pub. Date: May 17, 2018

(65) Prior Publication Data

US 2019/0266826 A1 Aug. 29, 2019

(30) Foreign Application Priority Data

Nov. 11, 2016 (DE) ..... 10 2016 013 515.8

(51) Int. Cl.
*G07D 7/12* (2016.01)
*G07D 11/50* (2019.01)
(Continued)

(52) U.S. Cl.
CPC ..... *G07D 7/12* (2013.01); *B65H 31/24* (2013.01); *B65H 43/00* (2013.01); *G07D 7/026* (2013.01);
(Continued)

(58) Field of Classification Search
CPC ..... G07D 7/12; G07D 11/50; G07D 7/026; G07D 7/04; G07D 2207/00; B65H 43/00; B65H 31/24
See application file for complete search history.

(56) References Cited

U.S. PATENT DOCUMENTS 6,311,819 B1 * 11/2001 Stromme ..... G07D 7/003 194/207
7,440,604 B2 10/2008 Tsuji et al.
(Continued)

FOREIGN PATENT DOCUMENTS

CN 1573823 A 2/2005
CN 105830128 A 8/2016
(Continued)

OTHER PUBLICATIONS

Office Action from corresponding Chinese Application No. 201780068459.7, dated Sep. 1, 2020.
(Continued)

*Primary Examiner* — Howard J Sanders
(74) *Attorney, Agent, or Firm* — Workman Nydegger

(57) ABSTRACT

An apparatus and method for classifying value documents includes least two sensor devices arranged to capture waves reflected on a front side and on a back side of a value document and to generate corresponding sensor data or to capture properties of the value document in at least two different regions of the value document by means of different measuring principles and to generate corresponding sensor data. At least one evaluation device is arranged to
(Continued)

classify the value document with the aid of the sensor data generated by the at least two sensor devices, which sensor data relate to the waves reflected on the front side and back side of the value document or to the properties of the value document captured in the at least two different regions of the value document by means of different measuring principles.

19 Claims, 1 Drawing Sheet

(51) Int. Cl.

| | |
|---|---|
| ***B65H 31/24*** | (2006.01) |
| ***B65H 43/00*** | (2006.01) |
| ***G07D 7/026*** | (2016.01) |
| ***G07D 7/04*** | (2016.01) |
| ***G07D 7/06*** | (2006.01) |

(52) U.S. Cl.
CPC ..... *G07D 7/04* (2013.01); *G07D 7/06* (2013.01); *G07D 11/50* (2019.01); *G07D 2207/00* (2013.01); *G07D 2211/00* (2013.01)

(56) References Cited

U.S. PATENT DOCUMENTS

| | | | | |
|---|---|---|---|---|
| 8,331,643 | B2 * | 12/2012 | Yacoubian | G07D 7/121 382/135 |
| 9,141,876 | B1 * | 9/2015 | Jones | G07D 11/36 |
| 9,666,007 | B2 | 5/2017 | Hecht et al. | |
| 10,573,113 | B2 * | 2/2020 | Derks | G07D 7/08 |
| 2004/0240721 | A1 | 12/2004 | Tsuji et al. | |
| 2016/0321851 | A1 | 11/2016 | Hecht et al. | |

FOREIGN PATENT DOCUMENTS

| | | | |
|---|---|---|---|
| DE | 102009057348 | A1 | 6/2010 |
| JP | 2004355261 | A | 12/2004 |
| WO | 9840839 | A2 | 9/1998 |

OTHER PUBLICATIONS

International Search Report and Written Opinion from PCT Application No. PCT/EP2017/001302, dated Mar. 5, 2018.

* cited by examiner

DEVICE AND METHOD FOR CLASSIFYING VALUE DOCUMENTS, IN PARTICULAR BANK NOTES, AND VALUE DOCUMENT PROCESSING SYSTEM

BACKGROUND

The invention relates to an apparatus and a method for classifying value documents as well as to a value-document processing system having such an apparatus.

Upon the machine processing of value documents, for example bank notes, cheques, coupons or vouchers, these are often classified, for instance with regard to denomination, authenticity and/or state, and depending on the result of the classification they are further processed, for example sorted. For this purpose, properties of the value documents are captured by means of sensors. The sensors have respectively assigned thereto a processor unit in which the raw data generated by the respective sensor are subjected to a pre-evaluation. With the aid of the results of the pre-evaluations in the different processor units, a classification of the respective value document is performed in a central instance and the value document is sorted accordingly.

SUMMARY

It is the object of the present invention to make the classification of value documents more reliable and more efficient.

This object is achieved by the apparatus and the method for classifying value documents according to the independent claims as well as by the value-document processing system having such an apparatus.

The apparatus for classifying value documents, in particular bank notes, according to the invention, has at least two sensor devices which are arranged to capture waves, in particular electromagnetic waves, reflected on a front side and on a back side of a value document and to generate corresponding sensor data or to capture properties of the value document in at least two different regions of the value document by means of different measuring principles and to generate corresponding sensor data. At least one evaluation device is arranged to classify the value document with the aid of the sensor data generated by the at least two sensor devices, which sensor data relate to the waves reflected on the front side and back side of the value document or to the properties of the value document captured in the at least two different regions of the value document by means of different measuring principles.

The value-document processing system according to the invention has: an apparatus for classifying value documents according to the invention and a sorting apparatus which has different sorting pockets and is arranged to output the value documents into the different sorting pockets in dependence on the classification effected with the aid of the sensor data.

The method for classifying value documents according to the invention has the following steps: capturing waves, in particular electromagnetic waves, reflected on a front side and on a back side of a value document and generating corresponding sensor data or capturing properties of the value document in at least two different regions of the value document by means of different measuring principles and generating suitable sensor data; classifying the value document with the aid of the generated sensor data which relate to the waves reflected on the front side and back side of the value document or to the properties of the value document captured in the at least two different regions of the value document by means of different measuring principles.

One aspect of the invention is based on the approach of merging sensor data from several sensor devices in one evaluation device, evaluating the merged sensor data in the evaluation device, and classifying the value document according to the result of the evaluation of the merged sensor data. The merged sensor data are raw data which are generated by the sensor devices when these capture waves, in particular electromagnetic waves, reflected on the front side and on the back side of the value document. Alternatively, the merged sensor data are raw data which are generated by the sensor devices when these capture properties of the value document in at least two different regions of the value document by means of different measuring principles. By the merging in the evaluation device, the raw data generated by the different sensor devices can be directly linked with each other, for example correlated, upon the classification of the value document, which allows an especially reliable classification. Additionally, dependencies of the sensor data can be recognized and thus redundant evaluations, such as in separate processor units, can be avoided. On account of the merging of the sensor data of different sensor devices in one evaluation device one can also speak of a fusion or fusing the different sensor data or raw data. Since the sensor data of the several sensor devices required for a classification of a value document are present in the respective evaluation device, one can further do without a copying of sensor data or forwarding of results of a pre-evaluation of the sensor data into or to further evaluation devices. This allows a particularly efficient classification.

Altogether, the invention thus allows a reliable and efficient classification of value documents.

Sensor data or raw data within the context of the invention relate to the signals generated by a sensor device which are generated upon capturing a property of a value document. Sensor data thus represent e.g. the reflection behaviour and/or transmission behaviour of the value document with regard to electromagnetic waves or ultrasonic waves, the electric conductivity, dielectric or magnetic properties of the value document or of at least certain regions of the value document.

In a preferred embodiment the at least one evaluation device has a memory unit for data storage. Additionally, a control device is provided which is arranged to write the sensor data generated by the at least two sensor devices into the memory unit of the at least one evaluation device. This allows the at least one evaluation device to access the sensor data of all sensor devices at any time and to link the sensor data accordingly, so that the classification of the value document based thereon is especially reliable. In particular, in the memory unit there are thus always present current sensor data of the at least two sensor devices, so that the at least one evaluation device can classify the value document simply with the aid of the current sensor data.

The control device is preferably arranged to write the sensor data of the at least two sensor devices independently of each other into the memory unit, so that the sensor data can be processed more efficiently. If the sensor devices generate the sensor data for example with different clock rates, in particular because the capture of the properties of the value document is based on different measuring principles and/or the size of the different regions in which the properties are captured varies, the sensor data of a sensor device having a higher clock rate are written more often, in particular with the higher clock rate, into the memory device than the sensor data of another sensor device with a lower clock rate.

In a further preferred embodiment, at least two evaluation devices are provided which each have a memory unit. Additionally, the control device is arranged to write the sensor data generated by the at least two sensor devices into each memory unit of the at least two evaluation devices. This ensures that each evaluation device, preferably at any time, has access to current sensor data of all sensor devices and these sensor data can be linked, so that the classification based thereon becomes especially precise, i.e. reliable.

In a further preferred embodiment, each of the at least two sensor devices has assigned thereto an evaluation device. This is advantageous for example when each of the evaluation devices is arranged to carry out a classification with regard to a respectively specified class, in particular with the aid of a respectively specified algorithm, the classification with regard to the respectively specified class advantageously being based on sensor data of the sensor device to which the respective evaluation device is assigned. A class within the context of the invention relates to a feature of value documents, such as for example denomination, authenticity or state. For example, a value document can be classified especially reliably with regard to its denomination through sensor data of a sensor device which captures optical properties of the value document, while a value document can be classified especially reliably with regard to its authenticity through sensor data of a sensor device which captures magnetic and/or electric properties of the value document. Due to the fact that each sensor device has assigned thereto an evaluation device, the value documents can be classified with regard to different classes with the aid of the respectively advantageous sensor data. As, in so doing, the evaluation devices have also access to other sensor data of other sensor devices, however, the respectively advantageous sensor data can additionally be linked with other sensor data. This makes the classification still more reliable.

The evaluation devices are preferably arranged to perform a classification of a value document with regard to several classes by means of corresponding algorithms. This allows an evaluation device to carry out, e.g. after a classification of the value document with regard to one class for example on the basis of sensor data of the sensor device assigned to this evaluation device, a further classification with regard to a further class. This is possible, because each evaluation device has available the sensor data of other, in particular of all the other sensor devices. This avoids that the evaluation devices, which have carried out a classification especially fast, transition into an idle state. This makes classifications of value documents especially efficient.

In a further preferred embodiment, the sensor devices configured for capturing the electromagnetic waves reflected from the front side and back side of the value document have a first image sensor and a second image sensor. The first image sensor is preferably arranged to capture a remission image of the front side of the value document and to generate corresponding first image sensor data. The second image sensor is preferably arranged to capture a remission image of the back side of the value document and to generate corresponding second image sensor data. The evaluation device is arranged to classify the value document with the aid of the first image sensor data and the second image sensor data. This is especially advantageous when a classification of value documents is to be performed with regard to their denomination, because this can be ascertained especially reliably with the aid of remission image data of the front side and back side, for example by an analysis of the captured printed image or regions of the printed image, such as printed numbers. This embodiment is therefore advantageous in particular in connection with a denomination separation or sorting according to denomination. The evaluation device is thus preferably arranged to ascertain the denomination of the value document with the aid of the first image sensor data and the second image sensor data.

Preferably, the first image sensor and the second image sensor are configured as photodiode sensor array, CCD sensor array or CMOS sensor array.

In a further preferred embodiment, the sensor devices, which are configured for capturing properties of the value document in at least two different regions of the value document by means of different measuring principles, have at least two different sensor types of the following sensor types:

- an optical sensor, in particular an image sensor, which is arranged to capture optical properties of the value document and to generate corresponding sensor data,
- an ultrasonic sensor which is arranged to capture reflection properties and/or transmission properties of the value document for ultrasound and to generate corresponding sensor data,
- a capacitive sensor which is arranged to capture dielectric properties of the value document and to generate corresponding sensor data,
- a magnetic sensor which is arranged to capture magnetic properties of the value document and to generate corresponding sensor data.

The evaluation device is here configured to classify the value document with the aid of the sensor data generated by the at least two different sensor types, which sensor data relate to properties of the value document captured in the at least two different regions of the value document. By linking the sensor data of different sensor types obtained for the different regions of the value document, this can be classified with regard to certain classes, such as for example authenticity, especially reliably.

In a further preferred embodiment, the evaluation device is arranged to check the authenticity of the value document with the aid of the sensor data generated by the at least two different sensor types, which relate to properties of the value document captured in the at least two different regions of the value document, and/or to classify the value document accordingly. This is especially advantageous when different regions of the value document have different security features which can be captured by the respective sensor type especially reliably. In particular, in a region of the value document having an optical security feature, for example a specified pattern, reflected and or transmitted electromagnetic waves can be captured by an optical sensor, for example an image sensor. In a further region of the value document, which has a security feature to be captured by means of ultrasound, for example a watermark, the thickness of the value document can be captured with the aid of a locally resolving ultrasonic sensor. In a different region of the value document, however, which has a magnetic security feature, for example a lettering printed with magnetic ink, the magnetic field strength can be captured with the aid of a magnetic sensor, for example a Hall probe. In a further region of the value document, which has a capacitive or dielectric security feature, for example a metallic security strip, a dielectric constant or a conductivity can be ascertained with the aid of a dielectric sensor, for example of a capacitor.

BRIEF DESCRIPTION OF THE DRAWINGS

Further advantages, features and application possibilities of the present invention will result from the subsequent description in connection with the Figures. There are shown.

DETAILED DESCRIPTION OF VARIOUS EMBODIMENTS

Figure 1:
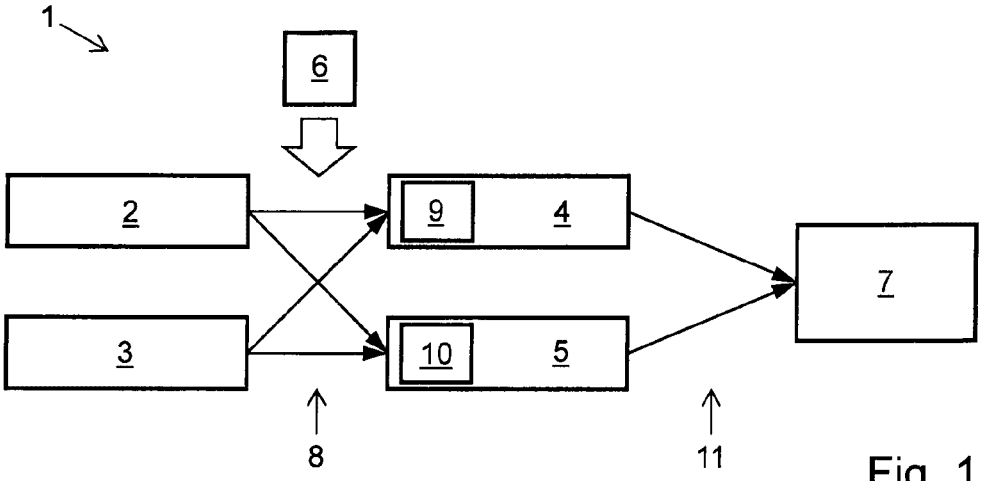
FIG. 1 an example of an apparatus for classifying value documents in a schematic representation.

FIG. 1 shows an example of an apparatus 1 for classifying value documents having a first sensor device 2, a second sensor device 3, a first evaluation device 4, a second evaluation device 5, and a control device 6.

The first sensor device 2 and the second sensor device 3 are arranged to capture properties of a value document, for example the transmission and/or reflectivity of the value document with regard to electromagnetic waves or ultrasonic waves, magnetic or dielectric properties of the value document, and to convert these into corresponding sensor data 8, so-called raw data. The sensor devices 2, 3 are configured accordingly, e.g., as optical sensors, in particular image sensors, piezoelectric ultrasonic sensors, Hall probes or capacitors.

Preferably, the first and/or second sensor device 2, 3 can capture the properties of the value document in locally resolved fashion. For this, the sensor devices 2, 3 or at least a part of the sensor devices 2, 3 preferably have respectively a one- or two-dimensional array of sensors, for example semiconductor detectors for capturing electromagnetic waves or piezoelectric elements for capturing ultrasound. Alternatively or additionally, the sensor devices 2, 3 can be arranged to scan the value document or at least a region of the value document, while the value document and the respective sensor device 2, 3 are moved relative to each other.

The sensor data 8 respectively generated by the sensor devices 2, 3 are written into a first memory device 9 of the first evaluation device 4 and into a second memory device 10 of the second evaluation device 5 by the control device 6, which is indicated by the arrows.

Preferably, the control device 6 here controls the data flow in such a way that the sensor data 8 of the two sensor devices 2, 3 are written into each of the memory units 9, 10 of the evaluation devices 4, 5, so that each of the evaluation devices 4, 5 has direct access to the sensor data 8 generated by the two sensor devices 2, 3. This allows that each of the evaluation devices 4, 5 has the possibility to classify a value document not only with the aid of the raw data generated by only one sensor device 2 or 3, but to take into account here also the raw data generated by the other sensor device 3 or 2, respectively, e.g. by a suitable linkage of the raw data.

The results 11 of the classification made in the evaluation devices 4, 5, which results preferably relate to different classes, are transferred to a central instance 7. For example, the first evaluation device 4 can be arranged to classify the value document with regard to its denomination, while the second evaluation device 5 can be arranged to classify the value document with regard to its authenticity.

The central instance 7 is preferably arranged to control a further processing, in particular sorting of the value document according to the results 11 of the classification. For example, all the value documents of a first denomination which were classified as authentic are output into the first container, while all the value documents of a second denomination which were classified as authentic are output into the second container, etc.

If the central instance 7 needs only one result 11 with regard to a class, for example because value documents are to be sorted only with respect to their denomination regardless of their authenticity or their quality, it is also possible to do without some evaluation devices, for example the second evaluation device 5.

Figure 2:
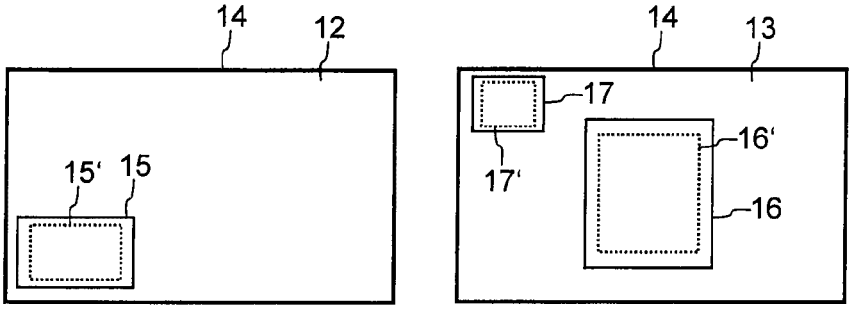
FIG. 2 an example of a value document from which waves reflected on the front side and back side are captured.

FIG. 2 shows an example of a front side 12 and a back side 13 of a value document 14 in a schematic representation for illustrating an advantageous application of the apparatus 1 shown in FIG. 1, for example the denomination separation.

The first and second sensor device 2, 3 (see FIG. 1) capture electromagnetic waves reflected, in particular remitted, on the front side 12 or on the back side 13, and generate corresponding first and second image sensor signals. Here, the first sensor device is preferably arranged to capture electromagnetic waves reflected in a first region 15 of the front side 12, while the second sensor device is arranged to capture electromagnetic waves reflected in a second region 16 and/or a third region 17 of the back side 13. For example, for this purpose, the first and second sensor device can be configured as image sensors, in particular as cameras, which capture the corresponding regions 15-17. Alternatively, the first image sensor can also be configured to capture the entire front side 12 of the value document 14 optically and to generate first image sensor data only with the aid of reflected electromagnetic waves captured in the first region 15. Accordingly, the second image sensor can be configured to capture the entire back side 13 of the value document 14 optically and to generate second image sensor data only with the aid of reflected electromagnetic waves captured in the second region 16 and in the third region 17.

The position and/or size of the first, second and/or third region 15-17 is preferably chosen such that there the value document has reflection properties which are characteristic for the denomination of the value document 14. For example, in the regions 15-17 the printed image of the value document 14 has certain features 15'-17', in particular in the form of a numeral and/or a pattern, with the aid of which the denomination of the value document 14 can be ascertained, for example whether it is a 5-euro bank note or 10-euro bank note.

The first and second sensor data, in the described example, are image sensor data which—as already explained in more detail in connection with FIG. 1—together are written into the memory device 9 of the first evaluation devices 4 and are linked with each other upon classification of the value document 14. This allows the classification of the value document 14 with regard to the denomination to be executed alone by the first evaluation device 4.

Due to the fact that in the first evaluation device the value document 14 can be classified with the aid of merged image sensor data, only one result of the classification, i.e. the denomination of the value document 14, must be transferred to the central instance 7. Further, in this case, the second evaluation device 5 for the classification of the value document 14 with regard to its denomination can be saved or be used for a classification with regard to a different class, as for example soiling.

The preceding explanations regarding the example shown in FIG. 2 also apply accordingly to electromagnetic waves which are transmitted by the value document 14 and are captured in the region of the front side 12 and back side 13 respectively by means of a sensor device. The explanations also apply accordingly to ultrasonic waves which are reflected and/or transmitted on the front side and back side of the value document 14 and are respectively recaptured by means of a suitable sensor device.

Figure 3:
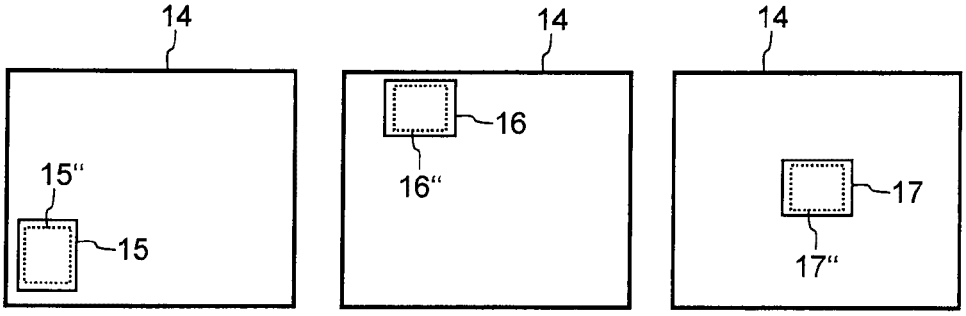
FIG. 3 an example of a value document whose properties are captured in different regions.

FIG. 3 shows an example of a value document 14 whose properties are captured with different sensor types in different regions 15-17. In the present example, the properties are captured with three different sensor types in three different regions of the value document. Depending on the case of application, only two, where applicable, but also more than three different sensor types may be utilized.

The different sensor types capture properties of the value document 14 with different measuring principles. For example, in the present example, this can be an image sensor, for example a camera, a dielectric or capacitive sensor, for example a capacitor, as well as an ultrasonic sensor, for example an array of piezoelectric elements. The sensors are preferably arranged to capture the respective properties of the value document 14 in locally resolved fashion, so that the accordingly generated sensor data respectively correspond to an optical, capacitive or ultrasonic image of the three different regions 15-17.

In the first region 15, the image sensor preferably captures an optical security feature 15" of the value document 14, for example a specified pattern. In the second region 16, the dielectric or capacitive sensor captures a dielectric security feature 16" of the value document 14, for example, a dielectric number of a security strip. In the third region 17, the ultrasonic sensor captures a security feature 17" of the value document 14 which is only capturable with the aid of ultrasonic waves, for example a varying thickness of the value document 14. Accordingly, these sensor data characterize the authenticity of the value document 14.

The sensor signals generated by the three different sensor types are written e.g. into the first memory device 9 of the first evaluation device 4 (see FIG. 1, for illustrative reasons, a third sensor device or a third sensor type is not represented there). This allows the sensor signals to be merged or jointly evaluated by the first evaluation device 4 in order to efficiently and reliably classify or check the value document 14 with respect to its authenticity.

For example, the first evaluation device 4 can be configured to evaluate the image points of the images corresponding to the three different regions 15-17 with regard to one or several, in particular three, threshold values.

Due to the fact that in the first evaluation device 4 the value document 14 is classified with the aid of merged sensor data, only one result of the classification, in the present example with regard to authenticity, of the value document 14 must be transferred to the central instance 7. The instance 7 itself does not need to perform a classification, but only controls the further processing, in particular sorting of the value document depending on the ascertained class. Thus, a second evaluation device 5 or any further evaluation devices (not represented in FIG. 1) for the classification of the value document 14 with regard to authenticity can be saved or be used for the classification with regard to a different class, as for example damages, soiling or limpness.

The invention claimed is:

1. An apparatus for classifying value documents, the apparatus comprising:

at least two sensor devices, including a first sensor device and a second sensor device, wherein the first sensor device and the second sensor devise are arranged to capture electromagnetic waves reflected on a front side and on a back side of a value document and to generate corresponding sensor data or to capture properties of the value document in at least two different regions of the value document by different measuring principles and to generate corresponding sensor data;

at least two evaluation devices, including a first evaluation device and a second evaluation device, wherein the first evaluation device and the second evaluation device each respectively includes a memory unit for data storage, and wherein each of the first evaluation device and the second evaluation device is arranged to classify the value document with the aid of the sensor data generated by the at least two sensor devices, including the sensor data generated by both the first sensor device and a second sensor device, wherein the sensor data relate to the waves reflected on the front side and back side of the value document or to the properties of the value document captured in the at least two different regions of the value document by different measuring principles; and a control device which is arranged to write the sensor data generated by the each of the first sensor device and the second sensor device into the memory unit of the first evaluation device, and the control device is further arranged to write the sensor data generated by each of the first sensor device and the second sensor device into the memory unit of the second evaluation device.

2. The apparatus according to claim 1, wherein the at least two sensor devices are configured for capturing electromagnetic waves reflected from the front side and back side of the value document and wherein the at least two sensor devices include a first image sensor and a second image sensor, wherein the first image sensor is arranged to capture a remission image of the front side of the value document and to generate corresponding first image sensor data and the second image sensor is arranged to capture a remission image of the back side of the value document and to generate corresponding second image sensor data, and the at least two evaluation devices are arranged to classify the value document with the aid of the first image sensor data and the second image sensor data.

3. The apparatus according to claim 2, wherein the at least two evaluation devices are arranged to ascertain the denomination of the value document with the aid of the first image sensor data and the second image sensor data.

4. The apparatus according to claim 1, wherein the at least two sensor devices are configured for capturing properties of the value document in at least two different regions of the value document by different measuring principles, and the at least two sensor devices include at least two different sensor types of the following sensor types:

an optical sensor which is arranged to capture optical properties of the value document and to generate corresponding sensor data, an ultrasonic sensor which is arranged to capture reflection properties and/or transmission properties of the value document for ultrasound and to generate corresponding sensor data, a capacitive sensor which is arranged to capture dielectric properties of the value document and to generate corresponding sensor data, a magnetic sensor which is arranged to capture magnetic properties of the value document and to generate corresponding sensor data, and the at least two evaluation devices are configured to classify the value document with the aid of the sensor data generated by the at least two different sensor types, which sensor data relate to properties of the value document captured in the at least two different regions of the value document.

5. The apparatus according to claim 4, wherein the at least two evaluation devices are arranged to check the authenticity of the value document with the aid of the sensor data generated by the at least two different sensor types, which sensor data relate to properties of the value document captured in the at least two different regions of the value document.

6. The apparatus according to claim 4, wherein the at least two sensor devices are arranged to capture electromagnetic waves reflected on the front side and on the back side of the value document and to generate the corresponding sensor data, and wherein the sensor data relate to the waves reflected on the front side and back side of the value document.

7. The apparatus according to claim 4, wherein the at least two sensor devices are arranged to capture properties of the value document in at least two different regions of the value document by different measuring principles and to generate the corresponding sensor data, and wherein the sensor data relate to the properties of the value document captured in the at least two different regions of the value document by the different measuring principles.

8. The apparatus according to claim 4, wherein the optical sensor is an image sensor.

9. A value-document processing system comprising:

an apparatus for classifying value documents according to claim 1, and wherein the value-document processing system is configured to sort and output the classified value documents in dependence on the classifications effected with the aid of the sensor data.

10. The apparatus according to claim 1, wherein apparatus is configured to classify bank notes.

11. The apparatus according to claim 1, wherein the at least two sensor devices are arranged to capture electromagnetic waves reflected on the front side and on the back side of the value document and to generate the corresponding sensor data, and wherein the sensor data relate to the waves reflected on the front side and back side of the value document.

12. The apparatus according to claim 1, wherein the at least two sensor devices are arranged to capture properties of the value document in at least two different regions of the value document by different measuring principles and to generate the corresponding sensor data, and wherein the sensor data relate to the properties of the value document captured in the at least two different regions of the value document by the different measuring principles.

13. The apparatus according to claim 1, wherein the apparatus is configured to merge the sensor data from each of the at least two sensor devices in each of the at least two evaluation devices to create merged sensor data in each of the respective memory units of each of the at least two evaluation devices.

14. The apparatus according to claim 13, wherein each the at least two evaluation devices is arranged to perform an evaluation of the merged sensor data.

15. The apparatus according to claim 14, wherein each the at least two evaluation devices is arranged to classify the value document according to a result of the evaluation of the merged sensor data.

16. The apparatus according to claim 13, wherein the merged sensor data are raw data which are generated by the at least two sensor devices.

17. The apparatus according to claim 1, wherein each of the at least two sensor devices have an evaluation device assigned thereto.

18. An apparatus for classifying value documents, the apparatus comprising:

at least two sensor devices, including a first sensor device and a second sensor device, wherein the first sensor device and the second sensor devise are arranged to capture electromagnetic waves reflected on a front side and on a back side of a value document and to generate corresponding sensor data or to capture properties of the value document in at least two different regions of the value document by different measuring principles and to generate corresponding sensor data;

wherein each of the at least two sensor devices has an evaluation device assigned thereto, wherein each of the evaluation devices respectively includes a memory unit for data storage, and wherein each of the evaluation devices is arranged to classify the value document with the aid of the sensor data generated by the at least two sensor devices, including the sensor data generated by both the first sensor device and a second sensor device, wherein the sensor data relate to the waves reflected on the front side and back side of the value document or to the properties of the value document captured in the at least two different regions of the value document by different measuring principles, wherein the sensor data generated by the each of the first sensor device and the second sensor device is written into the memory unit of the first evaluation device, and the control device is further arranged to write the sensor data generated by each of the first sensor device and the second sensor device into the memory unit of the second evaluation device.

19. A method for classifying value documents, the method comprising:

capturing, by at least two sensor devices including a first sensor device and a second sensor device, electromagnetic waves reflected on a front side and on a back side of a value document and generating corresponding sensor data or properties of the value document in at least two different regions of the value document by different measuring principles and generating corresponding sensor data;

providing at least two evaluation devices including a first evaluation device and a second evaluation device, wherein the first evaluation device and the second evaluation device each respectively includes a memory unit for data storage;

writing by a control device the sensor data generated by the each of the first sensor device and the second sensor device into the memory unit of the first evaluation device, and writing by the control device the sensor data generated by each of the first sensor device and the second sensor device into the memory unit of the second evaluation device;

classifying, by each of the first evaluation device and the second evaluation device, the value document with the aid of the generated sensor data which relate to the waves reflected on the front side and back side of the value document or to the properties of the value document captured in the at least two different regions of the value document by different measuring principles.

* * * * *